US008380343B2

(12) United States Patent
Wilke

(10) Patent No.: US 8,380,343 B2
(45) Date of Patent: Feb. 19, 2013

(54) METHOD AND APPARATUS FOR SORTING OF ITEMS IN TWO SORTING PROCESSES

(75) Inventor: Wolf-Stephan Wilke, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 173 days.

(21) Appl. No.: 12/768,239

(22) Filed: Apr. 27, 2010

(65) Prior Publication Data

US 2010/0274383 A1 Oct. 28, 2010

(30) Foreign Application Priority Data

Apr. 27, 2009 (DE) ..... 10 2009 019 054

(51) Int. Cl.
*B07C 5/00* (2006.01)

(52) U.S. Cl. ..... 700/223; 209/584

(58) Field of Classification Search ..... 700/223
See application file for complete search history.

(56) References Cited

U.S. PATENT DOCUMENTS

| | | | | |
|---|---|---|---|---|
| 6,239,397 | B1 * | 5/2001 | Rosenbaum et al. | 209/584 |
| 6,274,836 | B1 * | 8/2001 | Walach | 209/584 |
| 6,303,889 | B1 * | 10/2001 | Hayduchok et al. | 209/584 |
| 6,316,741 | B1 * | 11/2001 | Fitzgibbons et al. | 209/584 |
| 7,165,377 | B2 | 1/2007 | Gillet et al. | |
| 7,235,756 | B2 | 6/2007 | De Leo et al. | |
| 7,282,658 | B2 | 10/2007 | Hanson et al. | |
| 7,728,246 | B2 * | 6/2010 | Hanson et al. | 209/584 |
| 2004/0007510 | A1 * | 1/2004 | Kechel | 209/584 |
| 2005/0045531 | A1 * | 3/2005 | Bretschneider et al. | 209/584 |
| 2005/0279674 | A1 | 12/2005 | Gillet | |
| 2006/0016734 | A1 | 1/2006 | Madar et al. | |
| 2006/0283784 | A1 * | 12/2006 | Roth et al. | 209/584 |
| 2007/0154929 | A1 | 7/2007 | Hanson et al. | |
| 2007/0226156 | A1 | 9/2007 | De Leo et al. | |
| 2009/0074558 | A1 * | 3/2009 | Berger et al. | 414/806 |
| 2011/0211939 | A1 * | 9/2011 | Hugues et al. | 414/789.9 |

FOREIGN PATENT DOCUMENTS

| | | | |
|---|---|---|---|
| CA | 2574809 | A1 | 1/2006 |
| DE | 102004035365 | A1 | 2/2006 |
| EP | 1500440 | A1 | 1/2005 |

* cited by examiner

*Primary Examiner* — Gene Crawford
*Assistant Examiner* — Kyle Logan
(74) *Attorney, Agent, or Firm* — Laurence A. Greenberg; Werner H. Stemer; Ralph E. Locher

(57) ABSTRACT

A method and an apparatus sort items, in particular of flat postal items, in two sorting processes. Two classes of items are sorted on the basis of a sorting feature such that a predetermined sequence of the feature values is maintained. In a first sorting process, a sorting system sorts the items in the first class separately from the items in the second class. In the process, the sorting system determines which possible feature values are actually assumed by at least one item in the second class. The sorting system generates a sequence of item sets. These item sets and the items in the second class are jointly sorted by a sorting installation. In the second sorting process, the sorting installation generates the predetermined feature value sequence of the items of both classes.

8 Claims, 6 Drawing Sheets

| AE-1 | AE-2 | AE-3 | AE-4 | AE-5 | AE-6 | AE-7 | AE-8 | AE-9 |
|---|---|---|---|---|---|---|---|---|
| | | | | | | Z(27) | | |
| | | | | | | Z(26) | | |
| | Z(8) | | | | | Z(25) | | Z(36) |
| | Z(7) | | Z(14) | Z(18) | | Z(24) | Z(31) | Z(35) |
| Z(3) | Z(6) | | Z(13) | Z(17) | | Z(23) | Z(30) | Z(34) |
| Z(2) | Z(5) | Z(10) | Z(12) | Z(16) | Z(20) | Z(22) | Z(29) | Z(33) |
| Z(1) | Z(4) | Z(9) | Z(11) | Z(15) | Z(19) | Z(21) | Z(28) | Z(32) |

METHOD AND APPARATUS FOR SORTING OF ITEMS IN TWO SORTING PROCESSES

CROSS-REFERENCE TO RELATED APPLICATION

This application claims the priority, under 35 U.S.C. §119, of German application DE 10 2009 019 054.6, filed Apr. 27, 2009, the prior application is herewith incorporated by reference in its entirety.

BACKGROUND OF THE INVENTION

Field of the Invention

The invention relates to a method and an apparatus for sorting items, in particular of flat postal items, in two sorting processes.

U.S. patent publication No. 20060283784 A1 discloses that postal items or other items be first of all presorted, for example into different classes, which are defined by the dimensions of the postal items. A sorting installation for the first class ("letters", that is to say standard letters) sorts the postal items in this class in accordance with a predetermined destination point sequence. The postal items in the second class ("flats", that is to say large letters) are likewise sorted, and in the process are mixed with the postal items in the first class. In one embodiment, the postal items in the first class are sorted in two sorting runs ("two-pass sorting"). A first sorting run is carried out for the postal items in the second class. Sorted stack elements of standard letters are mixed with the large letters in a second sorting run. In this case, the stack elements are introduced between a flow of large letters.

European patent EP 1500440 B1, corresponding to U.S. Pat. No. 7,235,756, describes a system and a method for processing postal items of different formats separately, and then to process them jointly. A distinction is drawn between three classes of postal items: a first class with standard postal items (standard letters with postcards, "regular mail"), a second class with large letters ("flat mail items") and a third class with oversized postal items, which are difficult to process ("oversized mail items"). A sorting installation in each case sorts postal items in one class as far as the delivery route ("delivery point processing unit"). Each sorting installation forms stacks of postal items in one class which are to be transported to destination addresses in a region. These postal items in the classes are then sorted on the basis of destination addresses in order in this way to prepare a delivery route for a postman.

U.S. Pat. No. 7,165,377 B2 proposes that postal items from two different classes be separated individually. A reading device then determines the respective destination address. All postal items pass by a multiplicity of sorting end points over a closed transport path. One sorting end point is provided for each possible destination address. Each postal item is moved to that sorting end point which is intended for the destination address of the postal item. All postal items to one destination address are stacked in the sorting end point and are then combined to form a bundle, for example in a bag or using a film.

SUMMARY OF THE INVENTION

It is accordingly an object of the invention to provide a method and an apparatus for sorting of items in two sorting processes which overcome the above-mentioned disadvantages of the prior art methods and devices of this general type, in which the sorting installation requires fewer output devices in the second sorting process than known methods and apparatuses, when fewer items in the second class have to be transported than items in the first class.

With the foregoing and other objects in view there is provided, in accordance with the invention a method for sorting items in two sorting processes. The method includes predetermining a sorting feature, on a basis of which the items are to be sorted, a feature value sequence of possible feature values of the sorting feature, and at least one physical parameter. The items are subdivided into at least two classes in dependence on the at least one physical parameter, such that each item belongs to one class. A first sorting process is carried out via a sorting system. The sorting system sorts the items in a first class separately from the items in a second class. The sorting system for each item, measures which value the sorting feature assumes for the item and combines the items in the first class to form a plurality of item sets. A second sorting process is carried out via a sorting installation having a plurality of output devices. The sorting installation outputs the items in both the first and second classes in the second sorting process into the output devices of the sorting installation such that after the second sorting process, the items are sorted in accordance with the feature value sequence. The sorting system determines which of the possible feature values were actually measured for the items in the second class. The feature value sequence is subdivided into a sequence of sequences of successive feature values such that at most one actually measured feature value which was actually measured for the second class occurs in each sequence and the actually measured feature value occurs as a first or last feature value in the respective sequence. The sorting system combines the items in the first class to form the item sets and form a set sequence of the item sets such that all the items with a same feature value belong to a same item set, and two items whose feature values belong to the same sequence and follow one another in the feature value sequence belong to two different item sets which follow one another in the set sequence. The items are supplied to the sorting installation such that, when the items in the first class are supplied, the set sequence that is produced is maintained for the item sets.

According to the solution, items are sorted in two successive sorting processes. The two sorting processes may overlap in time. Each item to be sorted is first subjected to the first sorting process, and then to the second sorting process.

The following are predetermined: at least one physical parameter, at least one feature on the basis of which the items are to be sorted, a feature value sequence for the possible values of the feature, and at least two classes of items to be sorted.

An item belongs to a first class when the value which the physical parameter for this item assumes is in a first predetermined value range, and belongs to a second class when the value is in a second value range.

A sorting system is used for the first sorting process, and a sorting installation is used for the second sorting process. The sorting installation for the second sorting process has a set of output devices. Some or all of these output devices are actually used in the second sorting process. An output device sequence for the output devices of the sorting installation is predetermined.

After the second sorting process, all the items should have been sorted in accordance with the feature value sequence, with the feature value sequence being subdivided between the actually used output devices as a function of the output device sequence.

In the first sorting process, the sorting system sorts the items in the first class separately from the items in the second class. For each item, the sorting system measures which value the sorting feature assumes for the item. Furthermore, the sorting system determines which possible feature values are actually in each case assumed by at least one item in the second class. The sorting system therefore determines which possible feature values actually occur for items in the second class. The other feature values are not assumed by any item to be sorted in the second class. The actually measured feature values subdivide the feature value sequence into sequences of successive feature values such that an actually measured feature value of an item in the second class occurs as the first or last feature value in each sequence. Furthermore, the feature value sequence determines a sequence order. A computation unit determines these sequences and their order.

In the first sorting process, the sorting system splits the items in the first class into item sets such that all the items with the same feature value are passed to the same set, and two items whose feature values belong to the same sequence and are different are passed to different item sets.

In the first sorting process, the sorting system splits the items in the first class between a plurality of item sets, and produces a set sequence of these sets. The sorting system in this case splits the items such that all items with the same feature value are passed to the same item set, and two items whose feature values belong to the same sequence and follow one another in the feature value sequence are passed to two item sets which follow one another in the item sequence.

The item sets and the items in the second class are passed to the sorting installation, and are supplied to the sorting installation. The sorting installation carries out at least one sorting run, such that each item passes through the sorting installation at least once. During the first sorting run, the set sequence is maintained, such that all the items in the first item set pass through the sorting installation first, and then all the items in the second item set, and so on.

The invention makes it possible to sort the items separately according to classes in the first sorting process. One sorting installation can therefore be used in each case for each class, which is matched to the respective sorting task and is optimized for throughput and/or operating costs. In contrast, the items are processed jointly in the second sorting process, as a result of which, at the end of the second sorting process, all the items are sorted on the basis of their feature values, that is to say the items in all the classes have been introduced into a single sequence. There is no need for them subsequently to be sorted once again.

Because all the items are sorted in the second sorting process, the output devices must be suitable for every item, that is to say also, for example, for large items. The invention indicates a way in which as few output devices as possible are used in the second sorting process, while the items which are still sorted separately in the first sorting process are nevertheless combined.

This effect is achieved in particular by producing the item sets in the first sorting process. The items in the first class are therefore presorted. This presorting means that fewer output devices are required in the second sorting process.

The invention makes it possible to combine items in different classes into a common delivery sequence without a robot having to introduce or insert items between a stack of already sorted items. A robot such as this can be expensive and costly to maintain.

In particular, the invention saves the need to introduce an item in the second class between two items in the first class into a spaced-apart stack, in order to create a delivery sequence. This insertion requires a special automatic handling device. The invention saves such an automatic device.

Furthermore, the invention saves the need to use a zip-fastener method in the second sorting process, in order to combine a plurality of items in different classes which have the same feature value. A zip-fastener method such as this is time-consuming and susceptible to errors. Thanks to the item sets, fewer processes are required for combination.

In one refinement, each item is provided with indications relating to a destination point to which this item is to be transported. The possible destination points act as the possible feature values, and a destination point sequence is predetermined.

The items can be subdivided into the at least two classes by combination of a plurality of parameters.

The invention can be used, for example, for sorting of flat postal items. In this application, the indications relating to the respective destination point act as the feature values of the sorting feature. Standard letters act as items in the first class, and large letters ("flats") act as items in the second class. The three dimensions length, height and thickness of a postal item preferably act as parameters by which the items are subdivided into classes. In general, considerably fewer large letters than standard letters need be transported. The invention indicates a way to make use of this fact in order to require fewer output devices.

Other features which are considered as characteristic for the invention are set forth in the appended claims.

Although the invention is illustrated and described herein as embodied in a method and an apparatus for sorting of items in two sorting processes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
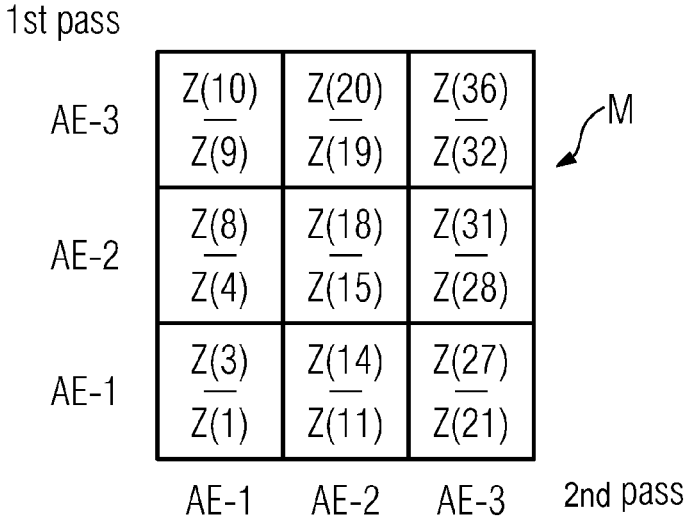
FIG. 1 is an illustration showing sorting plans for sorting runs of a second sorting process.

In the exemplary embodiment, the method is used to sort a set of flat postal items. Each flat postal item extends on an item plane and is provided with details relating to a destination address to which the postal item is to be transported. By way of example, the set of postal items is those flat postal items which are received in a predetermined time period in a predetermined first region for transport, for example by posting them in a letterbox or handing them over in a post office or postal agency, and which have to be transported to a predetermined second region.

In the exemplary embodiment, the destination addresses act as the feature values of the sorting feature. The measurement of this sorting feature contains the step of automatically and/or manually deciphering these destination addresses.

The postal items are sorted by two sorting processes. By way of example, all postal items which are received for transport in the coverage region of a first sorting center (in the first region) are sorted by an output sorting process. During the output sorting process, which acts as the first sorting process, a second sorting center is in each case determined for each postal item, and the postal item is transported to this second sorting center, after the first sorting process. The second sorting center is either the same sorting center as the first sorting center, or a different sorting center, in whose coverage area the destination address to which the postal item is to be transported is located. The second sorting center carries out an input sorting process for the incoming postal items, and this input sorting process acts as the second sorting process.

By way of example, the set of postal items contains all those postal items which have been received within a time period and have to be transported to destination addresses in the coverage region of the second sorting center. The region for which a second sorting center is responsible acts as the second region.

All sorting centers which are used for sorting domestic postal items are linked to a central database. Results of the first sorting process are recorded in this database. These results are available to all sorting centers for the second sorting process.

According to the solution, a distinction is drawn between at least two classes of postal items, on the basis of at least one physical parameter. By way of example, a postal item belongs to the first class when the postal item is a standard letter or a postal item and both its length (larger dimension on the item plane) and its height (smaller dimension on the item plane) as well as its thickness are each within a predetermined range. If one dimension is above this range, then the postal item is a large letter, and belongs to the second class. If one dimension is below the respective range, then the postal item belongs to a third class, or is not machine-compatible. By way of example, it is possible to distinguish between the three classes of postal items as have been described in U.S. patent publication No. 2006/0283784 A1 or in European patent EP 1500440 B1.

In addition to the dimension, further physical parameters can be used. The size or the surface character may also be physical parameters used as the basis for subdividing the postal items into classes.

A pretreatment device, for example a "culler facer canceller", roughly measures the postal items and splits the postal items into the predetermined classes, such that each sorting installation in the first sorting center is supplied only with postal items in one class. Furthermore, the postal items which are not machine-compatible are removed from the flow of postal items to be processed, in the pretreatment device.

In the exemplary embodiment, at least one first sorting installation in the first sorting center carries out the first sorting process. This first sorting installation has a number of output devices (sorting end points). The first sorting center acts as the sorting system in the sense of the patent claims.

In the first sorting process, each postal item passes at least once through a first sorting installation in the first sorting center. In each run, the respective sorting installation determines the respective destination address of each postal item, and outputs the postal item to an output device. If a plurality of sorting runs have been carried out ("n-pass sequencing"), then the postal items are once again supplied to the sorting installation after a sorting run, and pass through the sorting installation once again in a subsequent sorting run.

In one preferred embodiment, a plurality of first sorting installations are used in the first sorting center, for example in each case one sorting installation per class of machine-compatible postal items. The one sorting installation in the first sorting center sorts the postal items in the first class, that is to say for example the standard letters. The other sorting installation in the first sorting center sorts the postal items in the second class, that is to say for example the large letters. This allows two sorting installations to be used, which are optimized for the respective sorting task, that is to say for example a sorting installation which is optimized for high throughput for standard letters, and a sorting installation which can reliably sort large letters in different formats. In general, considerably more standard letters have to be sorted than large letters.

In the exemplary embodiment, sorting plans are generated for the second sorting run of the first sorting process and for the second sorting process after the first sorting run of the first sorting process has been completed.

A second sorting installation in the second sorting center uses the second sorting process to sort all postal items which are to be transported to a destination address in the coverage area of the second sorting center. After completion of the second sorting process, all of these postal items should have been sorted in accordance with a predetermined delivery sequence for the possible destination addresses. All postal items to be sorted in the first class and all postal items in the second class should be placed in a single delivery sequence, therefore the requirement for the two sorting processes. This avoids a postman having to manually combine a plurality of stacks, wherein each stack in each case contains sorted postal items in a single class.

Because there are more actually measured destination addresses than the second sorting installation has output devices (sorting end points) for postal items, two sorting runs are carried out in the second sorting process. After completion of the second sorting run, the second sorting installation will have output postal items into each output device, in each case in a predetermined delivery sequence for the possible destination addresses. Postal items sorted on the basis of the predetermined delivery sequence for destination addresses are therefore located in each output device.

In the second sorting process as well, each postal item passes through the second sorting installation at least twice. Exceptionally, one output device may in each case be reserved for recipients of a large number of postal items, and a postal item to a recipient such as this is output to the associated output device in a single sorting run.

In each run, the second sorting installation determines the respective destination address of each postal item, and outputs the postal item to an output device. The output device to which a postal item is output depends on its destination address.

After the first sorting run, the postal items are once again passed to the sorting installation. During this process, a predetermined feed sequence is maintained for the output devices. First of all, all postal items which the second sorting installation has output into the first output device in the feed sequence in the first sorting run are passed to the second sorting installation again, and pass through the second sorting installation. All postal items are then output from the second output device again in the feed sequence, and so on.

As already stated, the postal items in the first class are preferably sorted by a first sorting installation in the first sorting process, and the postal items in the second class are preferably sorted by a further sorting installation in the first sorting center. The two sorting installations can operate without any time synchronization. This embodiment means that the postal items in the at least two classes reach the second sorting center successively, that is to say for example all the standard letters first, and then all the large letters, or vice versa. These postal items are at least transported in different transport devices, for example in different containers. However, it is also possible for some containers to be transported with postal items in the first class, then containers with postal items in the second class, then in the first class again, and so on, to the second sorting center.

After the second sorting run, the predetermined delivery sequence is produced for the machine-compatible postal items in all classes.

Each sorting installation uses in each case one computer-available sorting plan in each sorting run. This sorting plan in each case associates each possible destination address with one output device. The sorting installation outputs each postal item in each sorting run into that output device which is associated by the sorting plan for this sorting run with the destination address of the postal item. Because the intention is to sort the postal items in the second sorting process in a predetermined delivery sequence for a postman, all postal items with the same destination address are output into the same output device in both sorting runs of the second sorting process, irrespective of the class to which these postal items belong.

This sorting plan is preferably represented by a matrix M. The second sorting installation uses N1 output devices in order to output postal items in the first sorting run of the second sorting process, and N2 output devices in order to output postal items in the second sorting run of the second sorting process. This matrix then has N1 rows and N2 columns. It is possible for the second sorting installation to use the same N1=N2 output devices for outputting in both sorting runs. However, it is also possible for the sorting installation to use different output devices in the sorting runs, also a different number, such that N1>N2 or N2>N1 may occur. The magnitude of N1 and N2 is defined only after the first sorting run of the first sorting process.

By way of example, FIG. 1 shows the two sorting plans for the two sorting runs of the second sorting process. In this example, postal items are to be sorted for 36 possible destination addresses. These are referred to in the following text in a rising sequence from Z(1) to Z(36). The postal items are intended to be sorted in accordance with this delivery sequence (Z(1) first, then Z(2), . . . , and finally Z(36)). A matrix M is shown.

Three output devices AE-1, AE-2 and AE-3 in the second sorting installation are used for the second sorting process. The second sorting installation has more output devices. However, it is stipulated that only the three output devices AE-1, AE-2 and AE-3 will be used for these postal items. The way in which this stipulation is implemented automatically will be described further below. These three output devices AE-1, AE-2 and AE-3 are sufficiently large that there is also space in these output devices for postal items in the second class. The output devices therefore occupy considerably more space than the output devices of that first sorting installation which sorts the postal items in the first class.

The sorting plan in FIG. 1 for the second sorting run stipulates that all postal items for the destination addresses Z(1) to Z(10) should be output in the first output device AE-1 after the second sorting run of the second sorting process. The postal items for the destination address Z(1) should come first, followed by the postal items to the destination address Z(2), and so on. The postal items to the destination addresses Z(11) to Z(20) should be output into the second output device AE-2, to be precise in this sequence, and the postal items to the destination addresses Z(21) to Z(36) should be output to the third output device AE-3.

The delivery sequence for the destination addresses is therefore split between those three output devices AE-1, AE-2, AE-3 which are actually used in the second sorting run of the second sorting process. The delivery sequence and an output device sequence are used for this splitting process.

The following sequence is predetermined as the feed sequence: AE-1 first, then AE-2, then AE-3, then AE-4 and so on. This feed sequence defines a sequence for all the output devices in the second sorting installation, not only for the currently used output devices, and preferably results from the arrangement of the output devices in a longitudinal direction. In the exemplary embodiment, the feed sequence is the same as the output device sequence. However, it is possible for these two sequences to differ.

These sorting plans, which are illustrated by way of example in FIG. 1, are generated automatically. This is done using information which the first sorting center has obtained in the first sorting run of the first sorting process. This information includes:

For every possible destination address in the coverage area of the second sorting center: how many postal items in the first class which have been sorted in the first sorting process are to be transported to this destination address?

For every possible destination address: how many postal items in the second class are to be transported to this destination address?

This information is used first of all to generate the two sorting plans for the sorting runs of the second sorting process, which are shown by way of example in FIG. 1.

One constraint is that the aim is for the postal items to have been sorted in the predetermined delivery sequence after the second sorting process. The postal items in the second sorting run of the second sorting process must therefore be output to the output devices in this delivery sequence. In the example shown in FIG. 1, this is the sequence Z(1), then Z(2), then Z(3) etc. The postal items are intended to be distributed between the output devices in accordance with this delivery sequence and in accordance with the feed sequence (AE-1, then AE-2 etc.).

The feed sequence forms a further constraint to be complied with. This is because, after the second sorting run, the output devices should be emptied in accordance with this feed sequence, in order to produce the delivery sequence.

The solution furthermore stipulates the possible destination address to which at least one postal item in the second class should actually be transported. Because the second class includes large letters, and in general considerably fewer large letters are sent than standard letters, there are actually generally postal items in the second class only for some of the possible destination addresses. In the exemplary embodiment, these are the eight destination addresses Z(3), Z(8), Z(10), Z(14), Z(18), Z(20), Z(27) and Z(31). The predetermined delivery sequence for all the possible destination addresses defines a delivery sequence for these actually measured destination addresses for postal items in the second class.

This information from the first sorting process is used to derive a further constraint.

In the exemplary embodiment, the postal items are supplied separately on the basis of classes to the second sorting installation. First of all, the postal items in the first class pass through the second sorting installation in the first sorting run, and are split between the three output devices AE-1, AE-2, AE-3 in accordance with the sorting plan for the first sorting run. They are then followed by the postal items in the second class. The sorting installation adds postal items in the second class to a stack in an output device, with the stack growing on one side. In the exemplary embodiment, however, the second sorting installation may not insert a postal item in the second class between two postal items in the already formed stack. This would require expensive automatic handling devices. This also applies to the second sorting run.

The following second constraint results from this, and because the predetermined delivery sequence must be maintained: postal items in the second class with different destination addresses must be output to different output devices in the second sorting installation in the first sorting run of the second sorting process or in the second sorting run, or in both sorting runs. In other words: two postal items in the second class with different destination addresses should not be output to the same output device in both sorting runs. This constraint means that two different destination addresses, to which postal items in the second class are to be transported, must occur in two different matrix elements in the matrix M. Different destination addresses may, in contrast, occur in the same matrix element.

This constraint means that the postal items in the first class and the postal items in the second class are preferably sorted separately from one another in the first sorting process, preferably by different sorting installations, which are optimized for the respective sorting task. The postal items in the first class are therefore passed separately from the postal items in the second class to the second sorting center, in which the second sorting process is carried out.

A sorting installation may sort for a maximum of N1*N2 different destination devices in two sorting runs, when N1 output devices are used in the first sorting run and N2 output devices are used in the second sorting run.

In order to satisfy the constraint that two postal items in the second class with different destination addresses are not output to the same output device in the two sorting runs, N1*N2>=8. In the exemplary embodiment, N1=N2. Therefore, N1=N2=3 is chosen. The matrix M which describes the sorting plans for the second sorting process therefore has N1=3 rows and N2=3 columns.

The eight actual destination addresses for postal items in the second class are distributed between the output devices when the sorting plans for the second sorting process are generated.

Figure 2:
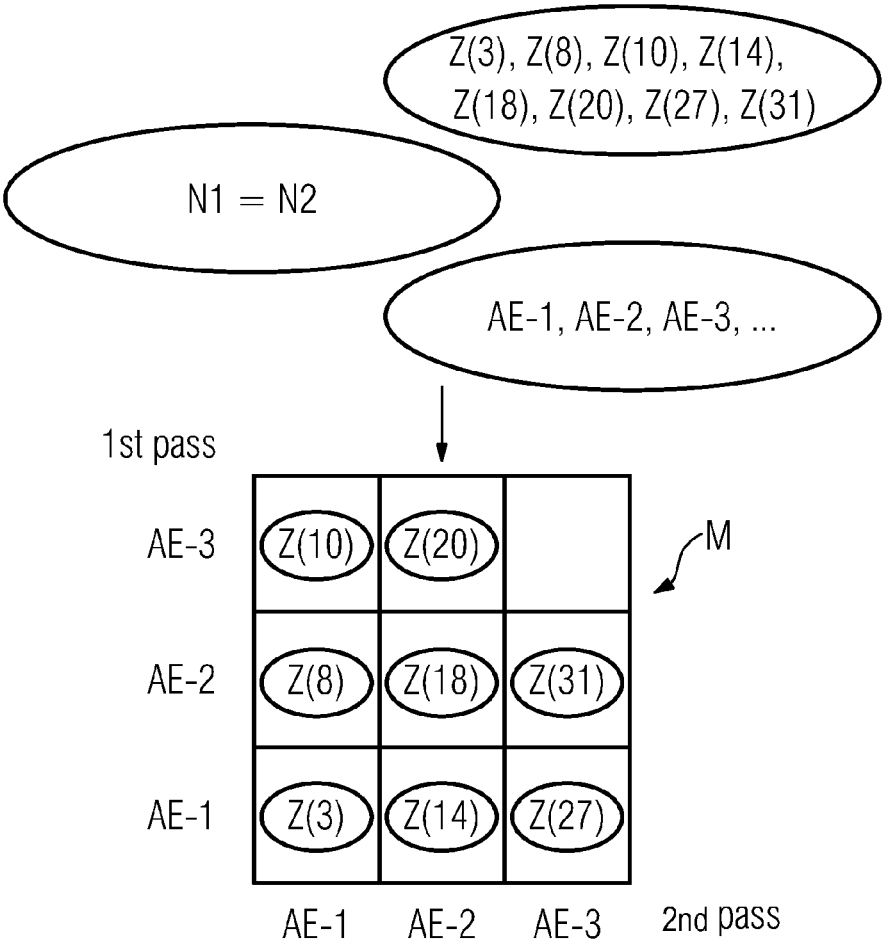
FIG. 2 is an illustration showing how delivery points to which large letters are to be transported are subdivided between output devices.

FIG. 2 illustrates which information is used in order to generate the two sorting plans for the second sorting run. Furthermore, FIG. 2 shows how the destination addresses to which postal items in the second class are to be transported are split between the output devices. In consequence, fields in the matrix M are filled with destination addresses for postal items in the second class. Those destination addresses to which postal items in the second class are to be transported are entered in the matrix M for the two sorting plans with the aid of circles.

The other destination addresses are then split between the output devices by splitting the destination addresses between the fields in the matrix M. The following constraints must be observed during this process:

In the second sorting process, the postal items should be sorted such that, after the second sorting process, all postal items in the first class and all postal items in the second class have been sorted in accordance with the predetermined delivery sequence. In particular, therefore, the large letters should be sorted into the sequence of the standard letters.

Because the postal items in the first class are sorted and delivered separately from the postal items in the second class in the first sorting process, the postal items in the first class also pass through the second sorting installation separately from the postal items in the second class, during the first sorting run of the second sorting process.

Once the destination addresses for postal items in the second class have been distributed between the output devices, by distributing these destination addresses between the fields of the matrix M, the other destination addresses are distributed between the fields in the matrix M, complying with the two constraints just mentioned. The destination addresses to which postal items in the second class are actually to be transported subdivide the predetermined delivery sequence into sequences. In the exemplary embodiment, the delivery sequence Z(1), Z(2), Z(3), . . . , Z(36) is predetermined for 36 possible destination addresses. The eight destination addresses Z(3), Z(8), Z(10), Z(14), Z(18), Z(20), Z(27) and Z(31) for postal items in the second class subdivide this delivery sequence into the following nine sequences. In this case, the eight destination addresses for postal items in the second class are contained as the last element in each case in the sequence. This is because the postal items in the first class are sorted first in the second sorting process, followed by the postal items in the second class, and the postal items in the second class are therefore supplied to the second sorting installation after the postal items in the first class.

In the exemplary embodiment, a sequence contains no feature value of a postal item in the second class at all. The previous feature values (destination addresses) in the sequence occur—if at all—only for postal items in the first class.

| Destination address for postal items in the second class | Previous destination addresses in the sequence |
|---|---|
| Z(3) | Z(1), Z(2) |
| Z(8) | Z(4), Z(5), Z(6), Z(7) |
| Z(10) | Z(9) |
| Z(14) | Z(11), Z(12), Z(13) |
| Z(18) | Z(15), Z(16), Z(17) |
| Z(20) | Z(19) |
| Z(27) | Z(21), Z(22), Z(23), Z(24), Z(25), Z(26) |
| Z(31) | Z(28), Z(29), Z(30) |
| (End) | Z(32), Z(33), Z(34), Z(35), Z(36) |

Therefore, overall, the second sequence in this example contains the destination addresses Z(4), Z(5), . . . , Z(8).

Each sequence which precedes a destination address for postal items in the second class (large letters) is in one refinement in each case associated with the same output device for each sorting run as this destination address, and therefore also the same field in the matrix M.

On the basis of the first sorting process, it is known for each such sequence how many postal items in the first class are to be transported in total to the destination addresses in this sequence. If this number is greater than a predetermined upper limit, then the sequence is preferably subdivided into at least two sub-sequences. Each sub-sequence and therefore each destination address in a sub-sequence is associated with in each case one output device for each sorting run, as a result of which different sub-sequences are associated with different output devices for each sorting run.

Figure 3:
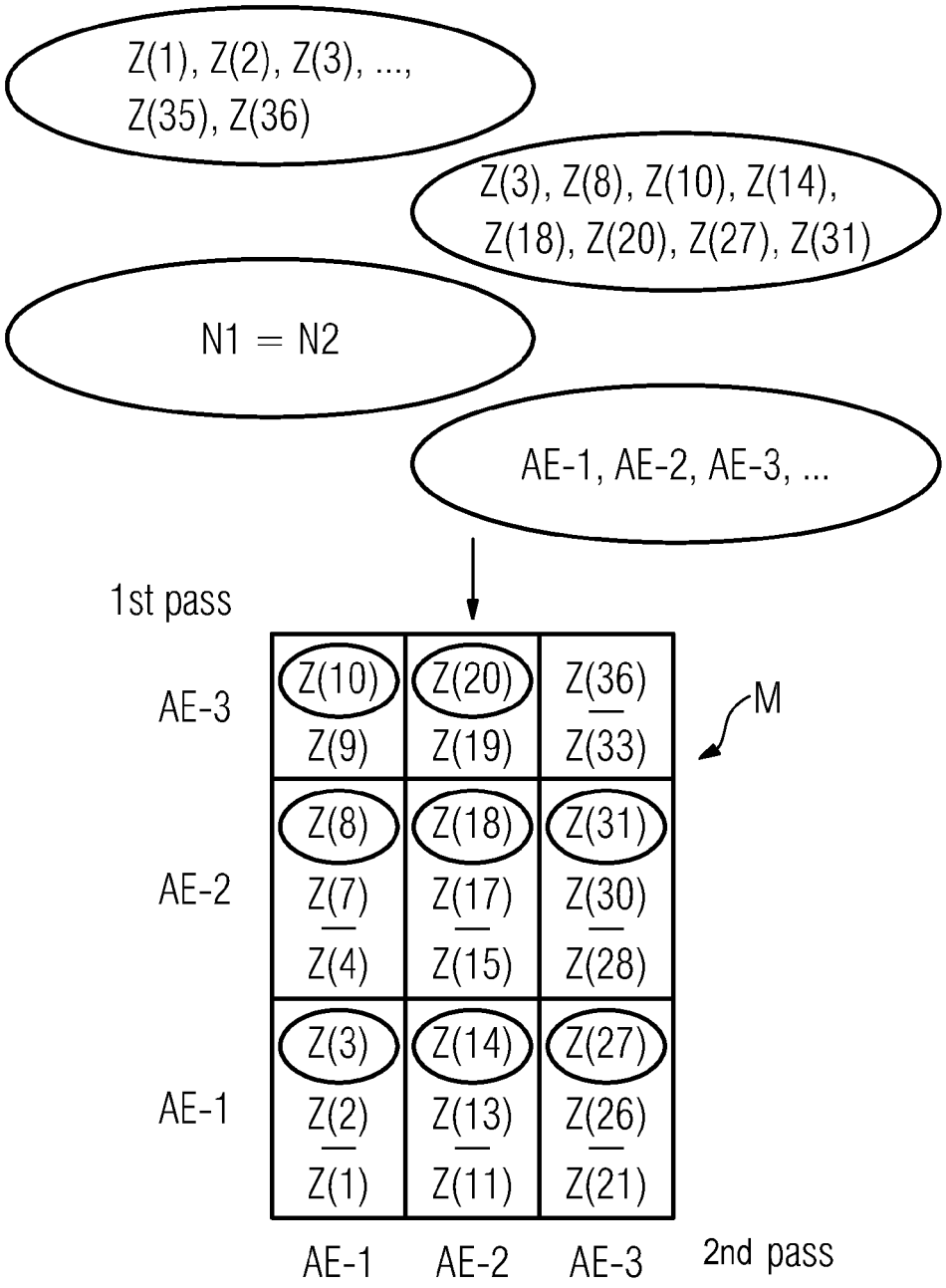
FIG. 3 is an illustration showing how the sorting plans of FIG. 1 are generated.

FIG. 3 illustrates how these sequences are associated with the fields in the matrix M. The associations in FIG. 2 and in FIG. 3 are combined, and result in the two sorting plans shown in FIG. 1.

The sequence in which postal items with the same destination address are output to an output device is irrelevant. However, postal items in the first class with different destination addresses are output to the same output device in the second sorting process. In order to ensure that the predetermined delivery sequence is maintained nevertheless, the first sorting installation in the first sorting center presorts the postal items in the first class, to be precise preferably in a second sorting run of the first sorting process, if the information described above relating to the postal items is already known, and preferably after the sorting plans have been generated for the second sorting process.

A plurality of stacks of postal items are formed in the second sorting run of the first sorting process. These stacks act as the item sets. These stacks are transported in a transport sequence of the stacks from the first to the second sorting center and are supplied in this sequence to the second sorting installation, and pass through the second sorting installation in the first sorting run of the second sorting process. First, the postal items in the first stack St(1) in the transport sequence pass through the second sorting installation, and are the first to be output to the output devices, followed by those in the second stack St(2), and so on.

The minimum number of stacks formed depends on how many different destination addresses are associated with the same output device in each sorting run of the second sorting process. Preferably, at least as many stacks are produced as there are different destination addresses with the same output device. In the exemplary embodiment, the sorting plan for the first sorting run of the second sorting process associates the seven destination addresses Z(21), Z(22), . . . , Z(27) with the same output device AE-1, and the output device AE-3 for the second sorting run. These seven destination addresses are therefore all entered in the same field in the matrix M, see FIG. 1.

Seven stacks St(1), St(2), . . . , St(7) are therefore formed, and the following transport sequence is defined: St(1) first, then St(2), . . . , then St-7. The seven destination addresses Z(21), Z(22), . . . , Z(27) are split between the seven stacks St(1), St(2), . . . , St(7) in the delivery sequence and this transport sequence.

All the other destination addressees are also split between these seven stacks. The following constraint is complied with during this process: if two different destination addresses Z(n) and Z(n+1), which follow one another in the delivery sequence, are associated with the same output device by each sorting plan of the second sorting process, then these two destination addresses are associated with two stacks, as follows: the destination address Z(n) is associated with a stack St(i), the destination address Z(n+1) is associated with a subsequent stack St(i+j), in the transport sequence, preferably the immediately subsequent stack S(i+1) (i=1, . . . , 6).

No specific sequence need be produced or maintained for the postal items in the first class within a stack St(i) (i=1, 2, . . . , 7). In fact, the postal items may have been sorted in any desired sequence within the stack St(i) after the first sorting process.

Figure 4:
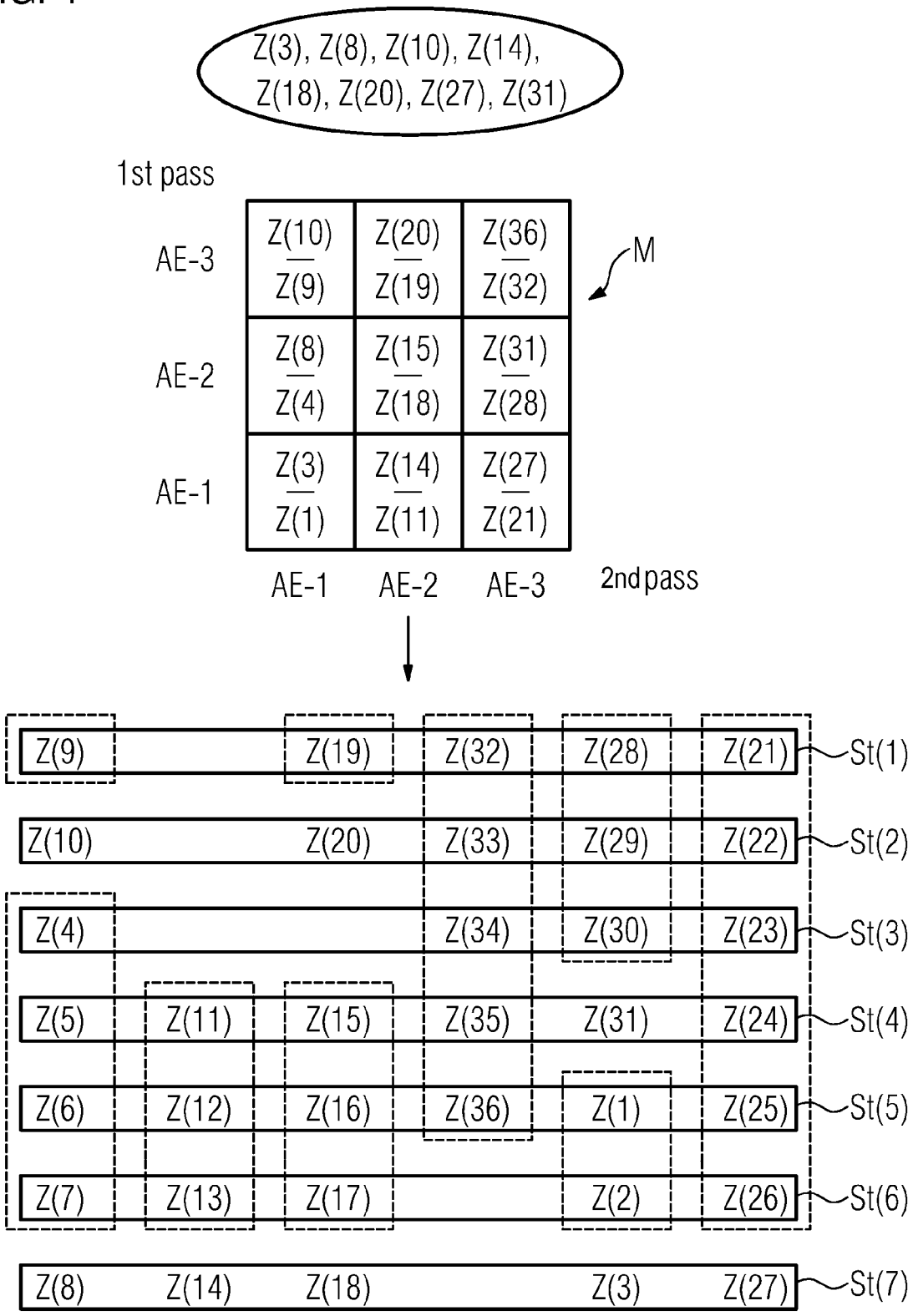
FIG. 4 is an illustration showing how the 36 destination addresses are subdivided between the seven stacks.

FIG. 4 shows which information is used in order to split the 36 destination addresses Z(1), Z(2), . . . between the seven stacks St(1), St(2), . . . , and how these 36 destination addresses are split between the seven stacks. Sequences are indicated as rectangles with dotted edges. In the example shown in FIG. 4, the stack St(4) contains all the postal items in the first class which are to be transported to one of the six destination addresses Z(5), Z(11), Z(15), Z(35), Z(31) and Z(24).

Figure 5A:
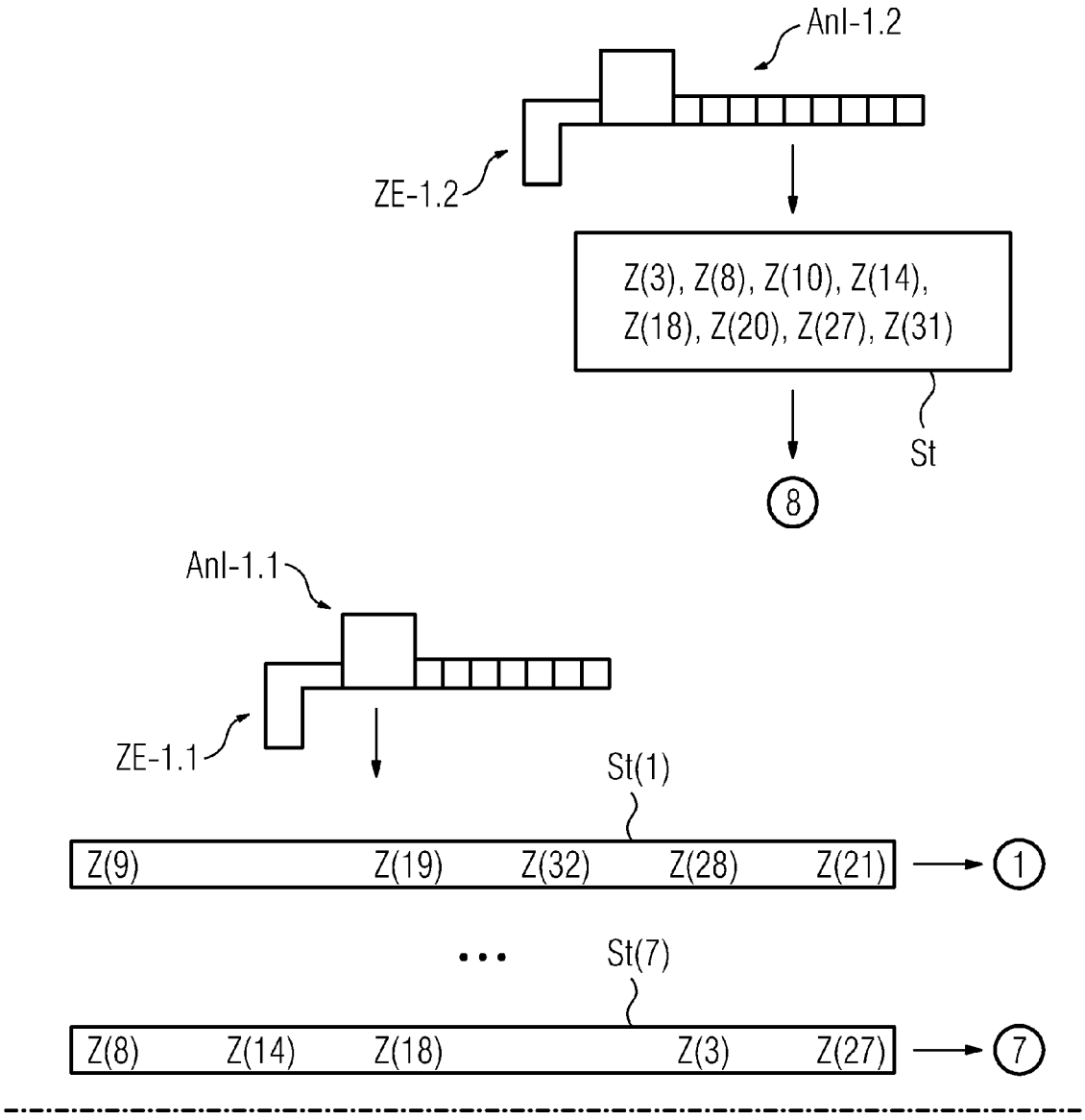
FIGS. 5A and 5B are illustrations showing how the postal items are sorted in the two sorting processes.

FIG. 5 illustrates how the postal items are sorted in the two sorting processes.

The postal items which arrive at the first sorting center are split between the respective classes in advance by a pretreatment device. A first sorting installation Anl-1.1 in the first sorting center sorts all the postal items in the second class, that is to say in particular the large letters. This first sorting installation Anl-1.1 defines the destination addresses to which postal items in the second class are actually to be transported, that is to say in the exemplary embodiment to Z(3), Z(8), Z(10), Z(14), Z(18), Z(20), Z(27) and Z(31). A computation unit in the first sorting center or a control center then produces the sorting plans for the second sorting process, which are illustrated in FIG. 1, with the intermediate steps as illustrated in FIG. 2 and FIG. 3 being carried out. Furthermore, this computation unit generates the stack forming rule, which is illustrated in FIG. 4.

A further first sorting installation Anl-1.1 in the first sorting center sorts all postal items in the first class, that is to say in particular the standard letters. This sorting installation Anl-1.1 reads the statements relating to the destination address on the postal item, and produces the seven stacks St(1), St(2), . . . of postal items in the first class in accordance with the stack forming rule, which is illustrated in FIG. 4 and which the computation unit generated in advance.

The sorting installations Anl-1.1 and Anl-1.2 each have a supply device ZE-1.1 and ZE-1.2.

The postal items in the first class and the postal items in the second class are transported to the second sorting installation Anl-2 in the second sorting center. The postal items in the second class are preferably transported in a single stack St to the second sorting center—or in a plurality of stacks which can be transported well.

First of all, the postal items in the first stack St(1) pass through the second sorting installation Anl-2 in the first sorting run, followed by the postal items in the second stack St(2), and so on to the seventh stack St(7). The postal items in the at least one stack St are then supplied with the postal items in the second class to the second sorting installation Anl-2, and likewise pass through the second sorting installation Anl-2. The postal items pass through the second sorting installation successively, and are output successively to a respective output device. There is no need in this case for one postal item to overtake another postal item, or for postal items also to be resorted in an output device. In fact, one stack is in each case formed in each output device, in which stack the postal items are stacked in that sequence in which they are output to this output device.

Figure 5B:
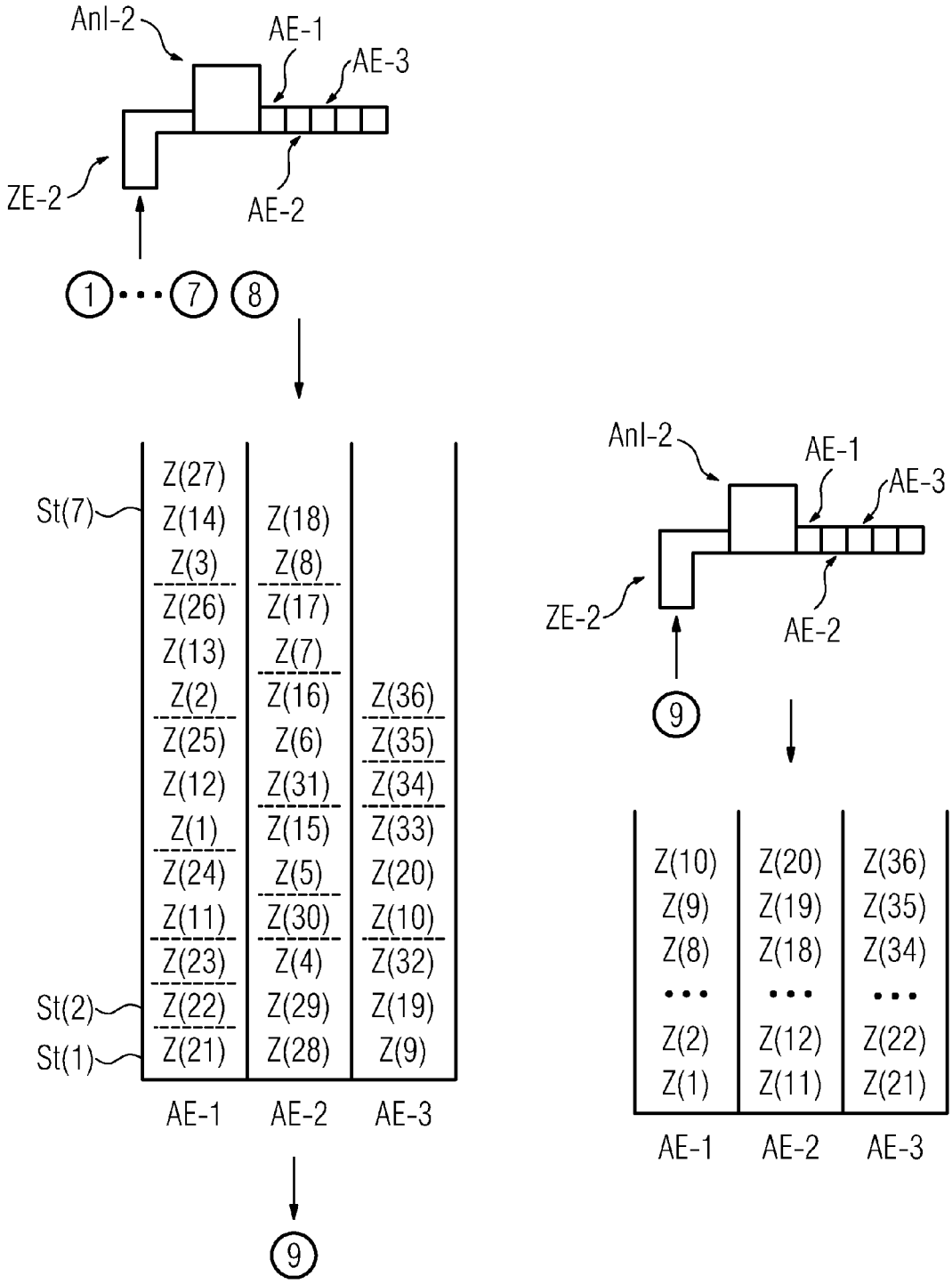

Once the first sorting run of the second sorting process has been completed, the postal items are distributed between the three output devices AE-1, AE-2, AE-3 as shown at the bottom left in FIG. 5B, to be precise in the sequence shown there. The sequence in which the postal items are output to an output device is governed by the sequence in which the stacks St(1), . . . , St(7), St are supplied to the second sorting installation Anl-2. For illustrative purposes, thin dashed lines are used to indicate which postal items come from which stacks. However, in the exemplary embodiment no separating elements or the like are provided in the output devices in order to separate the postal items from different stacks from one another.

The three output devices are then emptied in the feed sequence AE-1, then AE-2, then AE-3, and the postal items are once again supplied to the supply device ZE-2 in the second sorting installation Anl-2. In this case, the sequence for the postal items of one output device is maintained. In the second sorting run, the postal items pass through the second sorting installation Anl-2, to be precise in the sequence which is defined by the feed sequence for the output devices and the sequence within an output device. After completion of the second sorting run, the postal items in both classes will have been sorted in accordance with the predetermined feed sequence, as is indicated on the bottom on the right in FIG. 5.

Figure 6:
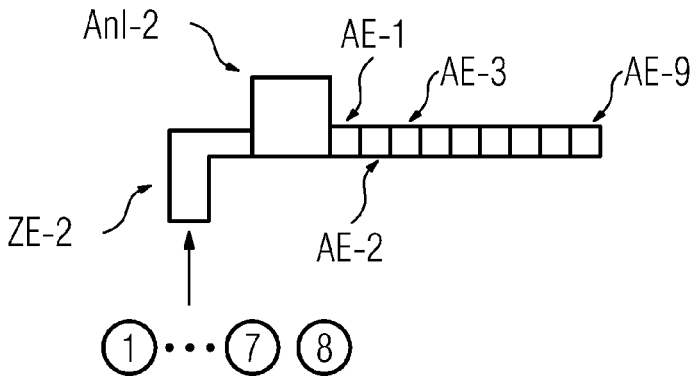
FIG. 6 is an illustration showing an alternative implementation of the second sorting process with only one sorting run.

FIG. 6 illustrates the second sorting process being carried out in an alternative manner, with only one sorting run. The previous first sorting process was carried out as illustrated in FIG. 5.

In this alternative refinement, the second sorting installation Anl-2 carries out only one sorting run. Nine output devices AE-1, AE-2, . . . , AE-9 are used for this purpose. The minimum number of output devices required when only one sorting run is intended to be carried out is defined when the first sorting process determines the destination addressees to which postal items in the second class are actually to be transported.

The invention claimed is:

1. A method for sorting items in two sorting processes, which comprises the steps of:

predetermining a sorting feature, on a basis of which the items are to be sorted;

predetermining a feature value sequence of possible feature values of the sorting feature;

predetermining at least one physical parameter;

subdividing the items into at least two classes in dependence on the at least one physical parameter, such that each item belongs to one class being either a first class or a second class;

carrying out a first sorting process via a sorting system, the sorting system sorts the items in the first class separately from the items in the second class, the sorting system for each item, measures which value the sorting feature assumes for the item and combines the items in the first class to form a plurality of item set, the first sorting process including the further steps of:

determining, via the sorting system, which of the possible feature values were actually measured for the items in the second class;

subdividing, via the sorting system, the feature value sequence into a sequence of sequences of successive feature values such that at most one actually measured feature value which was actually measured for the second class occurs in each sequence and the actually measured feature value occurs as a first or last feature value in the respective sequence;

forming the sequences such that the actually measured feature value which has actually been measured for the second class occurs as the first feature value in the sequence;

combining, using the sorting system, the items in the first class to form the item sets and form a set sequence of the item sets such that all the items with a same feature value belong to a same item set, and two items whose feature values belong to the same sequence and follow one another in the feature value sequence belong to two different item sets which follow one another in the set sequence;

carrying out a second sorting process via a sorting installation having a plurality of output devices, the sorting installation outputting the items in both the first and second classes in the second sorting process into the output devices of the sorting installation such that after the second sorting process, the items are sorted in accordance with the feature value sequence; and supplying the items to the sorting installation such that, when the items in the first class are supplied, the set sequence that is produced is maintained for the item sets; and supplying the items in the second class to the sorting installation first, and then the item sets.

2. The method according to claim 1, wherein:

fewer of the output devices of the sorting installation are used in the second sorting process than the sorting system has measured for both of the classes of the feature values; and the sorting installation carries out two successive sorting runs in the second sorting process and outputs the items in both of the classes into the output devices which are used in each sorting run, wherein, for the first sorting run, the items are supplied to the sorting installation such that the set sequence is maintained.

3. The method according to claim 2, wherein the sorting installation sorts the items such that the sorting installation outputs two items in the second class with different feature values in at least one sorting run into different ones of the output devices.

4. The method according to claim 1, wherein the sorting system contains a first sorting installation and a second sorting installation, and the method further comprises:

measuring, via the first sorting installation, the feature values for the items in the first class and producing the item sets; and measuring, via the second sorting installation, the feature values for the items in the second class.

5. The method according to claim 1, wherein:

the items supplied in the item sets pass through the sorting installation in at least one first sorting run in the second sorting process;

the sorting installation outputs the items into the output devices in the first sorting run;

the sorting installation outputs the items with the different feature values into at least one of the output devices; and in the first sorting process, the sorting system produces at least as many item sets as a number of the different feature values which occur in the output device after the first sorting run of the second sorting process.

6. The method according to claim 1, wherein:

the sorting installation uses at least one computer-available sorting plan to output each item in dependence on the feature value into one of the output devices; and each sorting plan which is used in the second sorting process is generated automatically, once the sorting system has measured the feature value for each item in the second class.

7. An apparatus for sorting items in two sorting processes, the apparatus comprising:

a subdivision device for subdividing the items in dependence on at least one physical parameter into at least two classes such that each item belongs to one class;

a data memory having a feature value sequence for possible feature values of a predetermined sorting feature;

a sorting system for carrying out a first sorting process, said sorting system programmed to carry out the first sorting process which:

sorts the items in a first class separately from the items in a second class;

measures, for each item, which value a sorting feature assumes for the item;

combines the items in the first class to form a plurality of item sets;

said sorting system determines which of the possible feature values have actually been measured for the items in the second class, and subdivides the feature value sequence into a sequence of sequences of successive feature values such that at most one actually measured feature value which was actually measured for the second class occurs in each sequence and the actually measured feature value occurs as the first or last feature value in the respective sequence, said sorting system programmed to form the sequences such that the actually measured feature value which has actually been measured for the second class occurs as the first feature value in the sequence, said sorting system furthermore combines the items in the first class to form the item sets, and forms a set sequence of the item sets, such that all the items with a same feature value belong to a same item set, and two items whose feature values belong to the same sequence and follow one another in the feature value sequence belong to two different item sets which follow one another in the set sequence;

a sorting installation having a plurality of output devices, said sorting installation carrying out a second sorting process and outputs the items in both the first and second classes in the second sorting process into said output devices of said sorting installation such that after the second sorting process, the items are sorted on a basis of the feature value sequence; and the apparatus supplies the items to said sorting installation such that when the items in the first class are supplied, the set sequence that is produced is maintained for the item sets, the apparatus supplying the items in the second class to the sorting installation first, and then the item sets.

8. The apparatus according to claim 7, wherein said sorting system contains a first sorting installation and a second sorting installation, said first sorting installation measures the feature values for the items in the first class and to produce the item sets, and said second sorting installation measures the feature values for the items in the second class.

* * * * *